US010301817B2

(12) United States Patent
Ackerley

(10) Patent No.: US 10,301,817 B2
(45) Date of Patent: May 28, 2019

(54) EXTERIOR INSULATING PANEL AND SYSTEM

(71) Applicant: Brian Ackerley, Innisfil (CA)

(72) Inventor: Brian Ackerley, Innisfil (CA)

(73) Assignee: Softwick Corp., Innisfil, Ontario (CA)

( * ) Notice: Subject to any disclaimer, the term of this patent is extended or adjusted under 35 U.S.C. 154(b) by 0 days.

(21) Appl. No.: 15/904,307

(22) Filed: Feb. 23, 2018

(65) Prior Publication Data

US 2018/0291618 A1 Oct. 11, 2018

Related U.S. Application Data

(60) Provisional application No. 62/462,722, filed on Feb. 23, 2017.

(51) Int. Cl.
*E04B 1/76* (2006.01)
*E04D 13/17* (2006.01)
*E04B 1/80* (2006.01)

(52) U.S. Cl.
CPC ..... *E04B 1/7629* (2013.01); *E04B 1/7641* (2013.01); *E04B 1/7645* (2013.01); *E04B 1/80* (2013.01); *E04D 13/178* (2013.01)

(58) Field of Classification Search
CPC .... E04B 1/7629; E04B 1/7641; E04B 1/7645; E04B 1/80; E04D 13/178; E04D 13/158; E04D 13/152
USPC ..... 52/84, 94, 95, 93.2, 302.1, 302.3
See application file for complete search history.

(56) References Cited

U.S. PATENT DOCUMENTS 4,007,672 A * 2/1977 Luckey ..... E04D 13/178 403/232.1
5,370,577 A * 12/1994 Jonett ..... E04C 3/02 454/260
7,487,618 B2 * 2/2009 Lin ..... E04D 13/15 52/300
8,966,845 B1 * 3/2015 Ciuperca ..... E04B 1/80 52/309.12
9,540,806 B2 * 1/2017 Lasselsberger ..... E04B 1/7645
2002/0124484 A1 * 9/2002 Martin ..... E04D 13/152 52/94
2011/0099920 A1 * 5/2011 Lin ..... E04H 9/14 52/84

(Continued)

FOREIGN PATENT DOCUMENTS

GB 2497179 * 11/2011

*Primary Examiner* — Brian E Glessner
*Assistant Examiner* — Adam G Barlow
(74) *Attorney, Agent, or Firm* — Gilbert's LLP; Matthew D. Powell

(57) ABSTRACT

An exterior insulating system for a building includes at least one insulating panel having a wall-facing side and an outward-facing side, a top and a bottom, the at least one insulating panel having a slope at the top that angles downwardly from the wall-facing side to the outward-facing side; at least one elongated clip member fastenable along a soffit that is extending outwards from a wall of the building; and at least one auxiliary panel having a first edge that is dimensioned to be received by the at least one elongated clip member opposite a main body of the at least one auxiliary panel from a second edge of the at least one auxiliary panel that is connectable to the at least one insulating panel, the main body incorporating structure for permitting airflow through the main body.

11 Claims, 12 Drawing Sheets

(56) References Cited

U.S. PATENT DOCUMENTS

| | | | | |
|---|---|---|---|---|
| 2012/0174511 | A1* | 7/2012 | Harding | B66F 9/142 52/302.1 |
| 2012/0324814 | A1* | 12/2012 | Amend | E04F 13/0875 52/302.1 |
| 2013/0205708 | A1* | 8/2013 | Shaw | E04D 13/172 52/742.12 |
| 2013/0255167 | A1* | 10/2013 | Concho | E04D 13/00 52/84 |
| 2014/0345223 | A1* | 11/2014 | Miks | E04B 1/4171 52/309.4 |
| 2016/0108612 | A1* | 4/2016 | Zhou | E04C 2/296 52/506.05 |
| 2016/0326739 | A1* | 11/2016 | Martel | E04B 1/7069 |

* cited by examiner

EXTERIOR INSULATING PANEL AND SYSTEM

CROSS-REFERENCE TO RELATED APPLICATION

This application claims priority to U.S. Provisional Patent Application Ser. No. 62/462,722 filed on Feb. 23, 2017, the contents of which are incorporated herein by reference in their entirety.

FIELD OF THE INVENTION

The present disclosure relates generally to building systems, and more particular to an exterior cladding panel and system for buildings.

BACKGROUND OF THE INVENTION

The construction of a building or dwelling is regulated by a set of standards, referred to collectively when contemplating construction, materials and the like as the building code. The building code is constantly evolving, and is intended to establish a minimum requirement for material dimensions and structural requirements with the objective of providing safe, comfortable and healthy environments.

Energy efficiency has received significant attention in the evolution of the building code, with a view to increasing energy efficiency or, at least, reducing energy consumption thereby to, in consequence, reduce the levels of CO2 in the atmosphere and the costs of operating a building. Newer buildings have been increasingly energy efficient, due to being increasingly insulated. However, with the increases in energy efficiency due to insulation, it has also been recognized that careful attention must be paid to ensuring proper ventilation within the building envelope to avoid condensation.

An area of particular focus for ventilation is the roof space. In roof space, hot moist air from within the building is subject to cooler ambient temperatures, leading to excessive condensation. Such condensation can lead to undesirable deterioration of the building materials. To avoid this, the building code in many jurisdictions mandates ventilation of the roof space to inhibit such condensation.

One scheme for ensuring adequate ventilation involves providing the building with an overhanging soffit running around the periphery of the building's roof, there being portions or the soffit that are perforated or that otherwise permit fluid flow along with one or more ridge or gable vents at elevated locations to promote continuous air circulation in the roof space. The soffit is an integral part of the building structure and is typically incorporated into the design of the roof trusses and/or of rafters. In particular, the roof extends outward from the wall a sufficient distance to provide the ventilation area through the soffit required by the building code after the wall cladding and fascia has been applied.

With the ever-present desire to maximize profits by keeping material to a minimum, the overhang of the soffit is often the minimum allowed by the building code at the time the house was built. In such arrangements, the entire soffit may be perforated to meet the ventilation requirements of the building code.

As for insulation, with new buildings, insulation can be integrated into walls during construction to ensure the buildings comply with the latest insulation requirements in the building code. However, for existing buildings other approaches are required to ensure the buildings better approach the insulation standards of the latest building code. For example, one approach is to add insulation to the exterior wall structure of an existing building. In particular, one may add sheet insulation to the exterior wall structure, using rectangular panels or sheets made of several inches of expanded polystyrene (EPS) such as Styrofoam™ available from Dow Chemical Corporation. After such insulating panels have been installed, a variety of finishes can be used to clad the exterior walls.

Adding EPS panels to the exterior of a building involves arranging the panels to abut the overhang. However, this results in several inches of the perforated soffit, corresponding to the several-inches thickness of the panels and any further cladding applied thereto, being blocked. This accordingly reduces free flow of air into and out of the building. As such, while the insulation has been improved, this consequent reduction in air flow can cause the building code to be contravened for failure to maintain adequate ventilation. Furthermore, it is generally not practical or cost effective to entirely restructure soffits to compensate for the blockages using existing techniques.

It is therefore an object of the present invention to obviate or mitigate the above disadvantages.

SUMMARY OF THE INVENTION

In accordance with an aspect of the invention, there is provided an exterior insulating system for a building, the system comprising at least one insulating panel having a wall-facing side and an outward-facing side, a top and a bottom, the at least one insulating panel having a bevel at the top that angles downwardly from the wall-facing side to the outward-facing side; at least one elongated clip member fastenable along a soffit that is extending outwards from a wall of the building; and at least one auxiliary panel having a first edge that is dimensioned to be received by the at least one elongated clip member opposite a main body of the at least one auxiliary panel from a second edge of the at least one auxiliary panel that is connectable to the at least one insulating panel, the main body incorporating structure for permitting airflow through the main body.

In an embodiment, the wall-facing side of the at least one insulating panel comprises a plurality of channels arranged to convey liquid that is between the wall-facing side and a wall of the building downwardly towards the bottom.

In an embodiment, the wall-facing side comprises a plurality of pedestals spaced from one another thereby to form the plurality of channels.

In an embodiment, the plurality of pedestals have a square shape.

In another embodiment, plurality of pedestals have one or more of: a diamond shape, a rectangular shape, a circular shape, an oval shape, or combinations thereof. The channels do not have to be parallel to each other throughout.

In an embodiment, each of the plurality of pedestals has a cavity in a midsection thereof that is open to the wall-facing side.

In an embodiment, the plurality of channels are open to the top and angle only downwardly thereby to permit liquid from towards the top of the at least one insulating panel to enter into the channels and to flow downwardly under gravity.

In an embodiment, a subset of the channels are open to the top. In an embodiment, only a subset of the channels angle downwardly.

In an embodiment, the slope is a bevel having an angle of 45 degrees with respect to the outward-facing side. In an embodiment, the slope is a bevel having an angle of from about 30 degrees to about 60 degrees with respect to the outward-facing side. In an embodiment, the slope is a bevel having an angle of from about 15 degrees to about 75 degrees with respect to the outward-facing side.

In an embodiment, the slope is a nonlinear curve.

In an embodiment, the second edge of the at least one auxiliary panel comprises holes therethrough for receiving a fastener to fasten the second edge to the at least one insulating panel.

In an embodiment, the structure for permitting airflow through the main body comprises perforations.

In another embodiment, the structure for permitting airflow through the main body comprises a mesh.

Other embodiments are contemplated herein.

BRIEF DESCRIPTION OF THE FIGURES

Embodiments will now be described more fully with reference to the accompany drawings, in which.

DETAILED DESCRIPTION OF THE EMBODIMENTS

Figure 1:
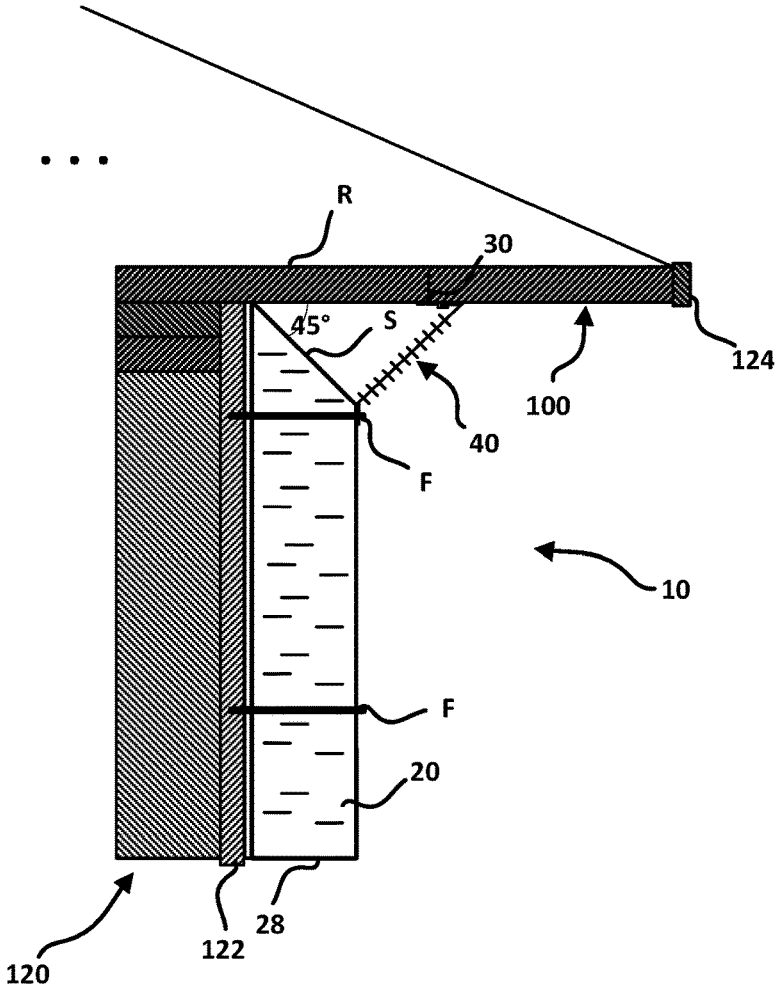
FIG. 1 is a side sectional view of portions of components of an exterior insulating system 10, for providing exterior insulation to a building.
Figure 2:
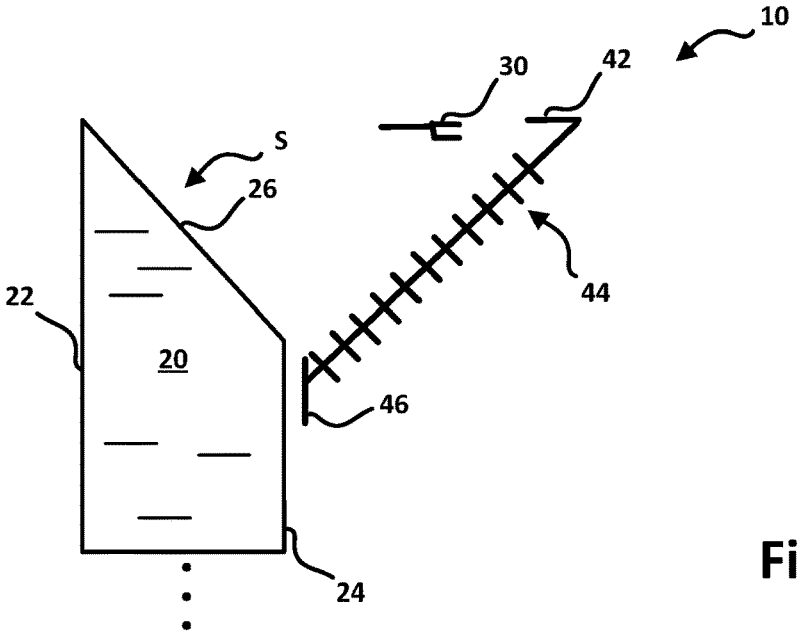
FIG. 2 is a side sectional enlarged view of portions of the components of FIG. 1.

FIG. 1 is a side sectional view of portions of components of an exterior insulating system 10, for providing exterior insulation to a building. FIG. 2 is a side sectional enlarged view of portions of the components of FIG. 1. System 10 is adapted for use in applying additional insulation to an existing building B, but may be used while constructing buildings anew, as the builder sees fit.

System 10 includes an insulating panel 20, in this embodiment formed from expanded polystyrene (EPS) and having a wall-facing side 22 and an outward-facing side 24. Insulating panel 20 has a top 26 and a bottom 28. At the top 26, which is adjacent to a soffit 100 of the building B and particularly the soffit channel supporting the soffit 100 in its position, there is a slope S downwardly from the wall-facing side 24 to the outward-facing side 26. In this embodiment, slope S is a 45 degree bevel. In FIG. 1, only one insulating panel 20 is shown, though installations will typically involve several insulating panels 20. Each insulating panel 20 is fastened to the wall with fasteners F.

System 10 also includes an elongated clip member 30 and an auxiliary panel 40, each of which are to be associated with the insulating panel or panels 20 as will be described. Elongated clip member 30 is, in this embodiment, formed of a length of aluminum curved to provide an elongate channel for receiving an edge portion of the auxiliary panel 40 angled with respect to other portions of the auxiliary panel 40 thereby to connect the auxiliary panel 40 with the elongated clip member 30. Elongated clip member 30 is fastenable first using fasteners (not shown in FIG. 1 but some mechanical fastener such as a self-tapping metal screw 31 such as depicted in the side sectional view of FIG. 2) to and along a soffit 100 that is extending outwards from a wall 120, and particularly the outer sheathing 122 (such as a sheet of particle board) of the building to which system 10 is to be applied. The distance from the sheathing 122 at which clip member 30 is positioned on soffit 100 is based partly on the width of the auxiliary panel member 40 and the angle at which the installer wishes to install auxiliary panel member 40 with respect to the soffit 100.

In FIG. 1, one auxiliary panel 40 is shown, though other installations may involve more than one auxiliary panel 40. Each auxiliary panel 40 includes a first edge 42 that is dimensioned to be received by the at least one elongated clip member 30. Furthermore, opposite a main body 44 of the auxiliary panel 40 from the first edge 42 is a second edge 46. In this embodiment, second edge has holes 48 therethrough for permitting passage of a fastener through the holes 48 and into and through the insulating panel 20. In other embodiments, second edge may be connectable to insulating panel in some other manner.

Each main body 44 of the auxiliary panels 40 is, in this embodiment, perforated to permit the free flow of air through the main body 44. In this manner, once installed in place, air may flow freely to and from within building via the perforated main body 44 and past the sloped top 26 and the soffit 100 itself. The sloped top 26 is useful for preventing blockage of soffit 100 as compared to an unsloped top 26 which would cover a segment of soffit 100 and therefore block the free flow of air. The sloped top 26 also provides more insulation to the upper regions of the wall 120 of the building than would simply spacing a flat-topped insulating panel from the soffit 100. This is because the sloped top 26 enables the insulating panel 20 of the present invention to reach to the top of the wall thereby providing some improved coverage of the wall than would the absence of insulation in prior art.

While system 10 is useful with one or more insulating panels 20 with sloped tops 26 because airflow is unblocked while still providing at least some additional insulation to the top of the wall, alternatives are contemplated in which installations involve simply using elongated clip member 30 and auxiliary panel 40 with standard insulating panels (those having non-sloped tops), where the standard insulating panels are spaced from the soffit 100 to provide airflow that meets building code.

Furthermore, alternatives are contemplated in which just the sloped-top insulating panel 20 of the invention is employed or provided, without provision or installation of the elongated clip member 30 or auxiliary panel 40, in order to provide insulation without air blockage where the finishing provided by the elongated clip member 30 and auxiliary panel 40 is not necessarily required.

Figure 3:
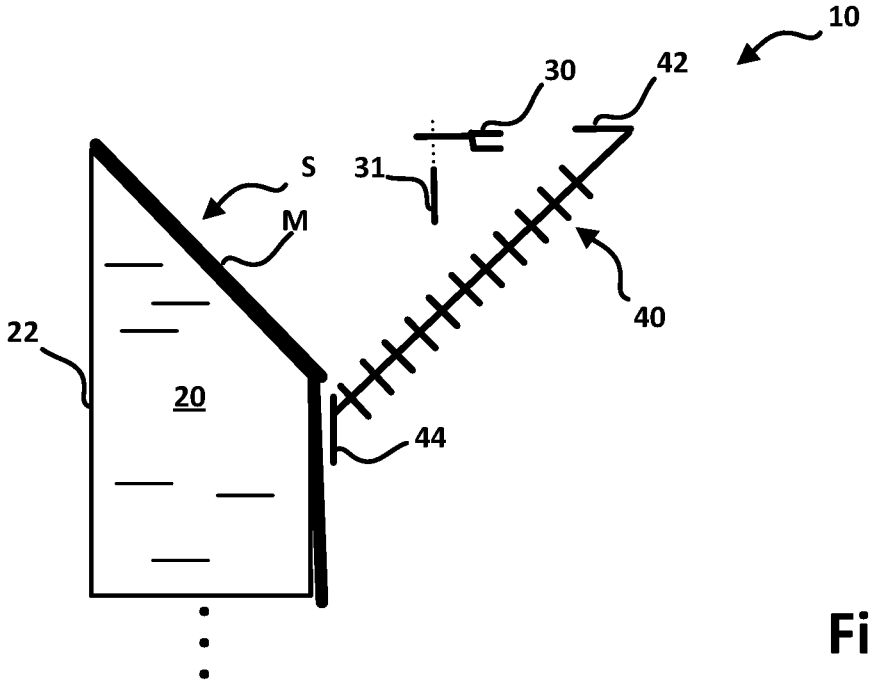
FIG. 3 is a side sectional enlarged view of portions of the components of FIG. 1 including a moisture management membrane.

As seen in FIG. 3, a drainage or moisture management membrane M is typically placed over the sheathing 122 to inhibit ingress of moisture into the sheathing 122. The wall 120 supports rafters R which project outwardly to a fascia 124.

System 10 enhances the insulation of the wall 120.

Figure 4:
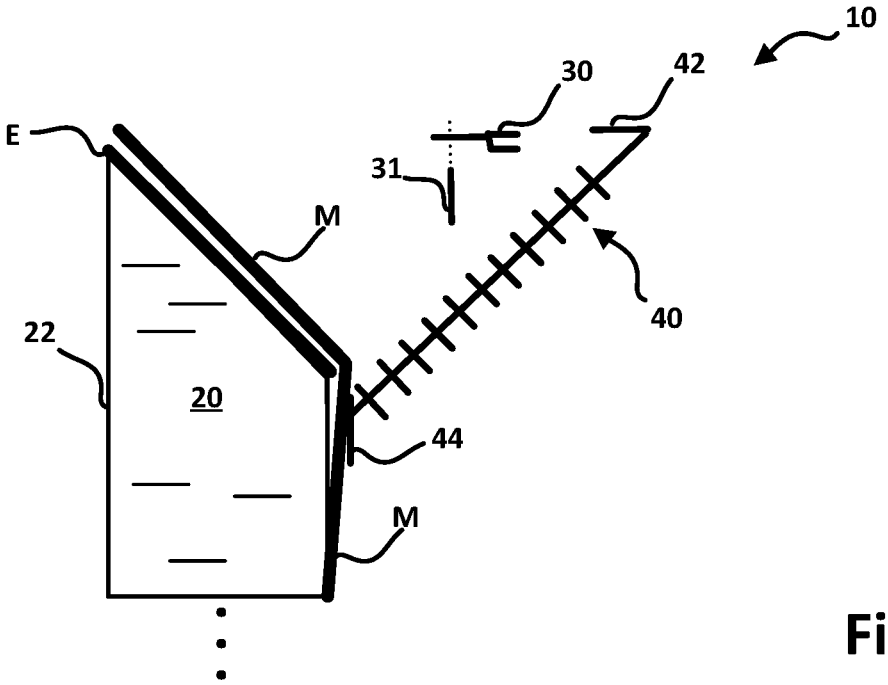
FIG. 4 is a side sectional enlarged view of portions of the components of FIG. 1 including a moisture management membrane and an end cap.
Figure 5:
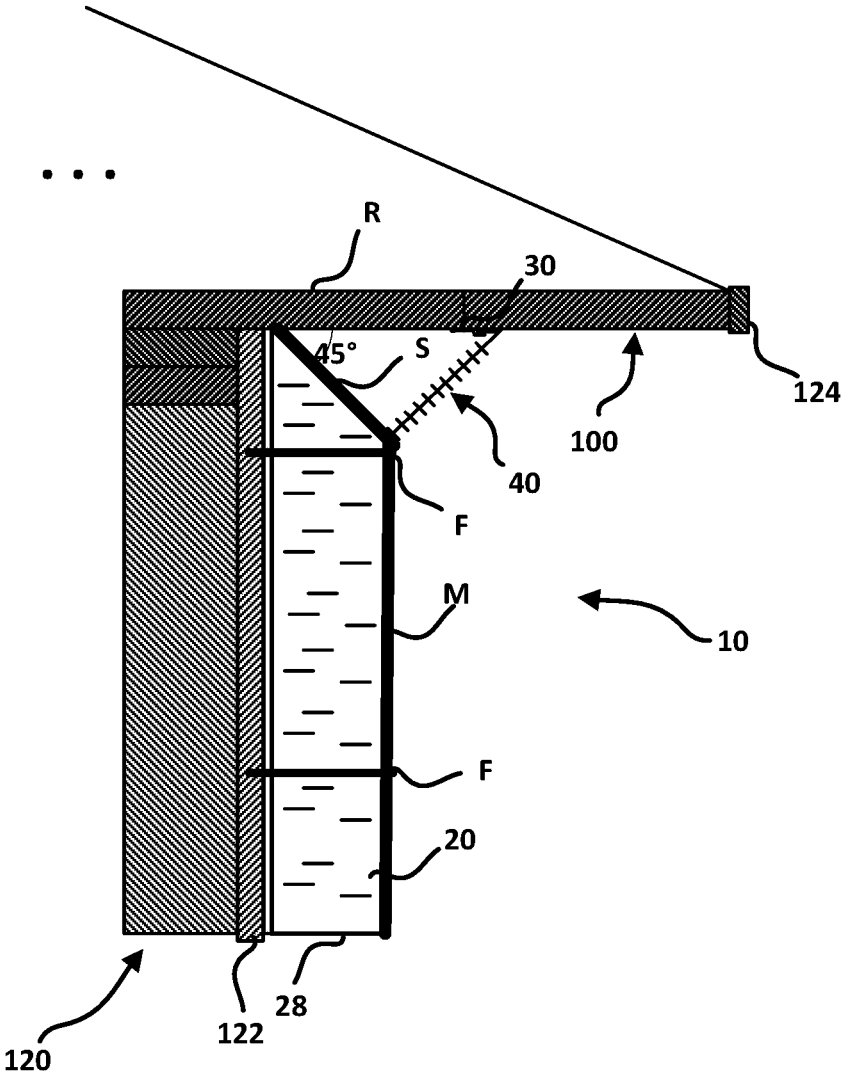
FIG. 5 is a side sectional view similar to FIG. 1.
Figure 6:
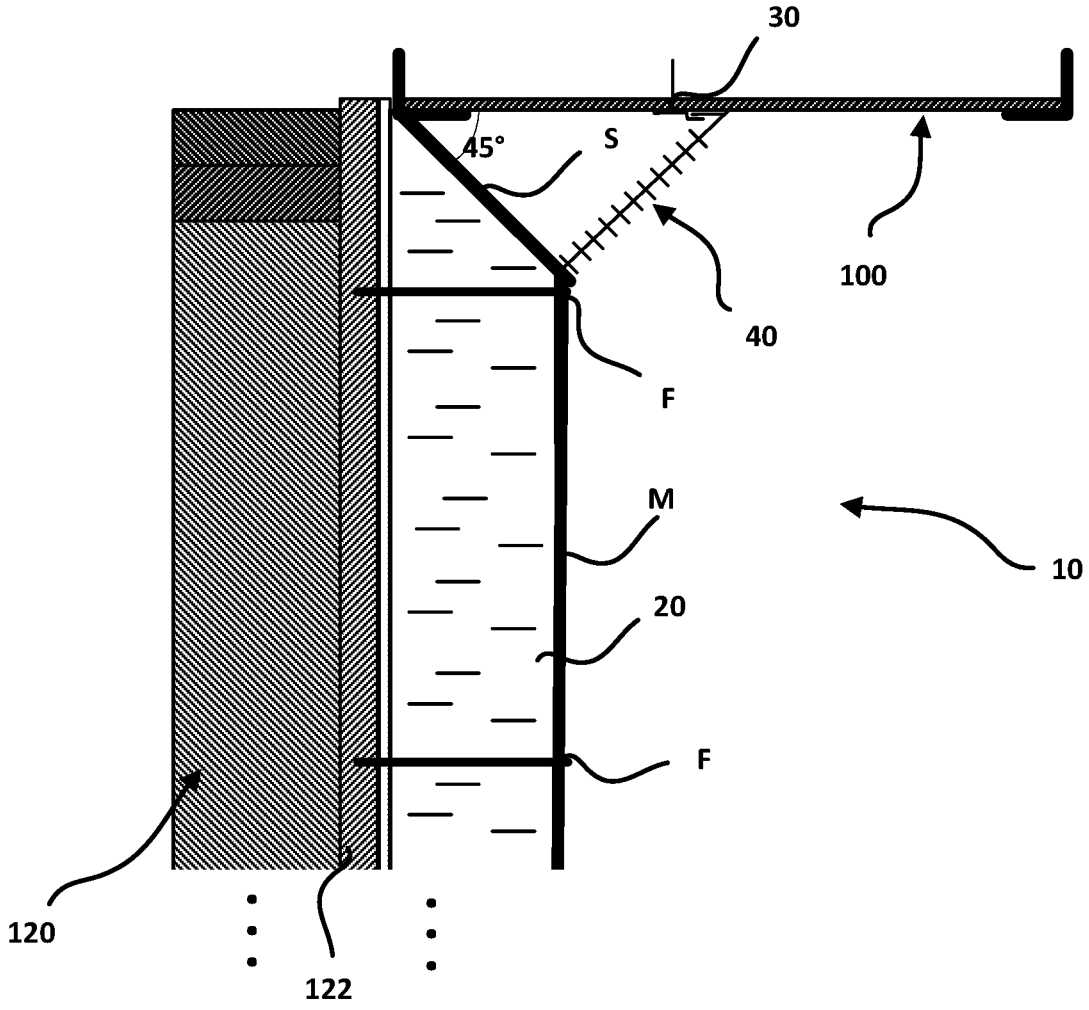
FIG. 6 is a side sectional enlarged view of portions of the components of FIG. 5.
Figure 8:
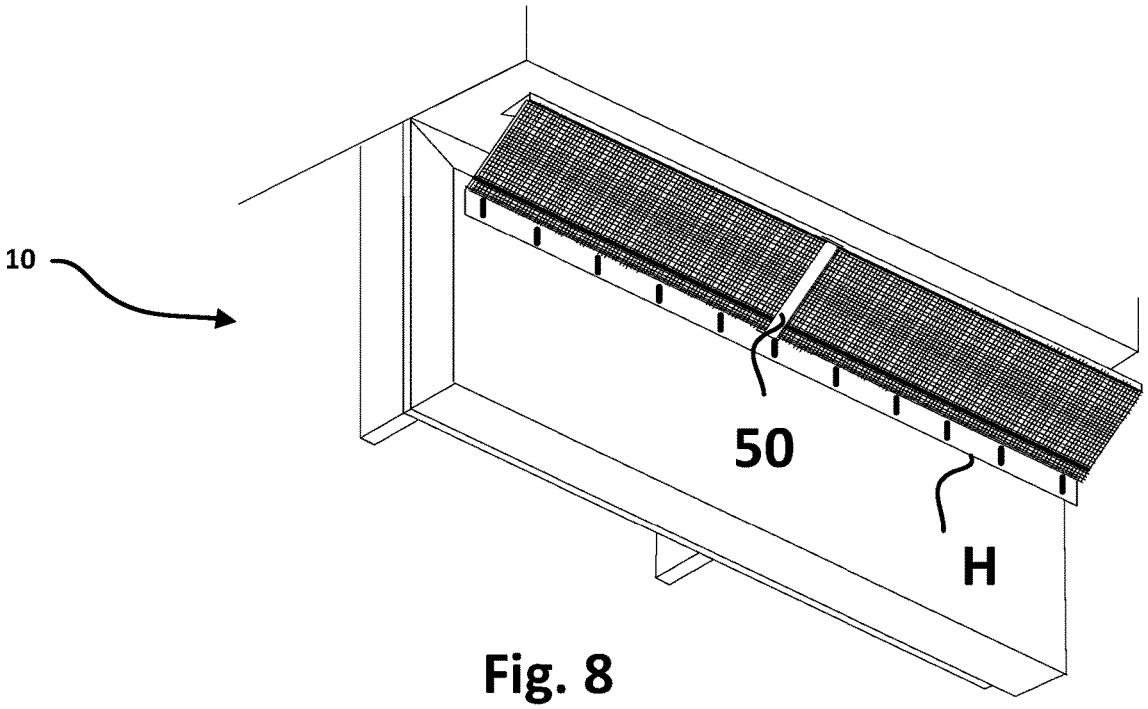
FIG. 8 show a side sectional view similar to FIG. 1, and a front perspective view of portions of components of the exterior insulation system 10.
Figure 9:
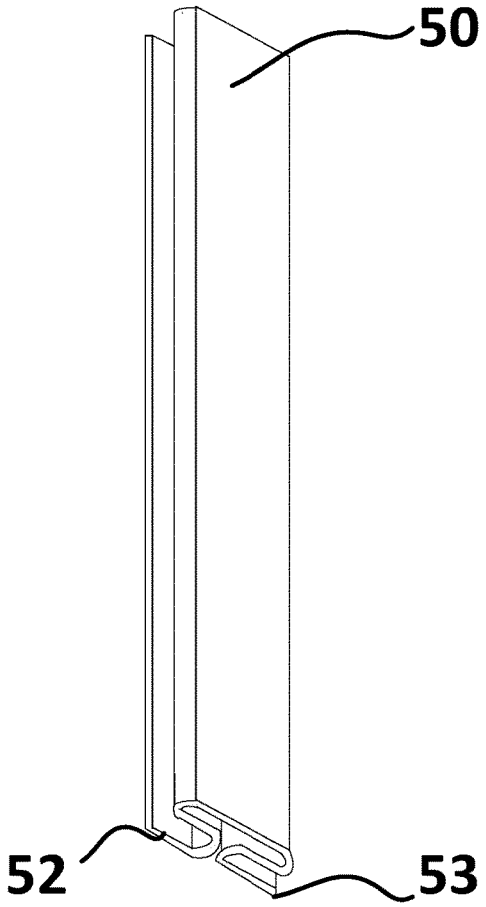
FIG. 9 is a front perspective view of an end clip 50 in a first configuration.
Figure 10:
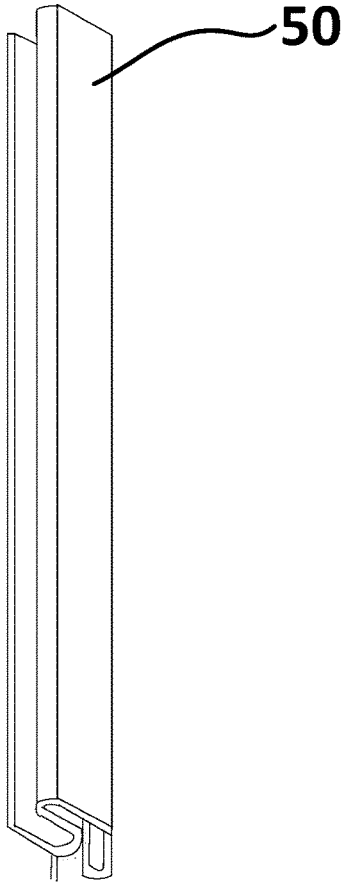
FIG. 10 is a front perspective view of an end clip in a second configuration.
Figure 11:
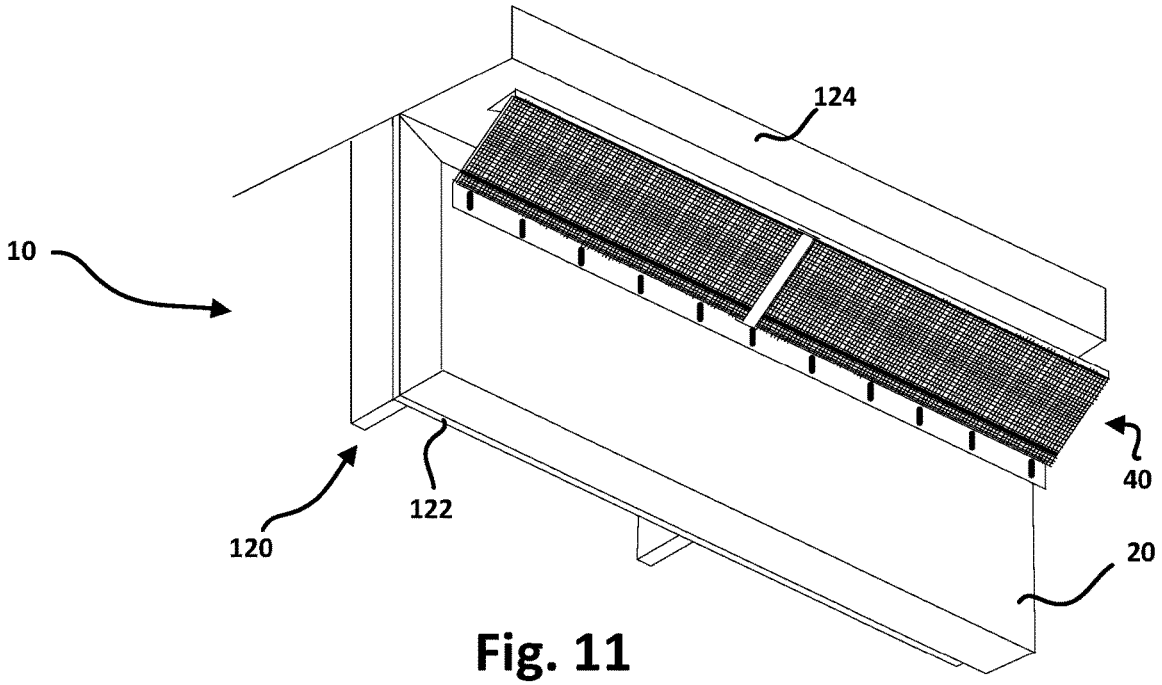
FIG. 11 is a front perspective view of portions of components of the exterior insulation system 10 similar to that shown in FIG. 8.
Figure 12:
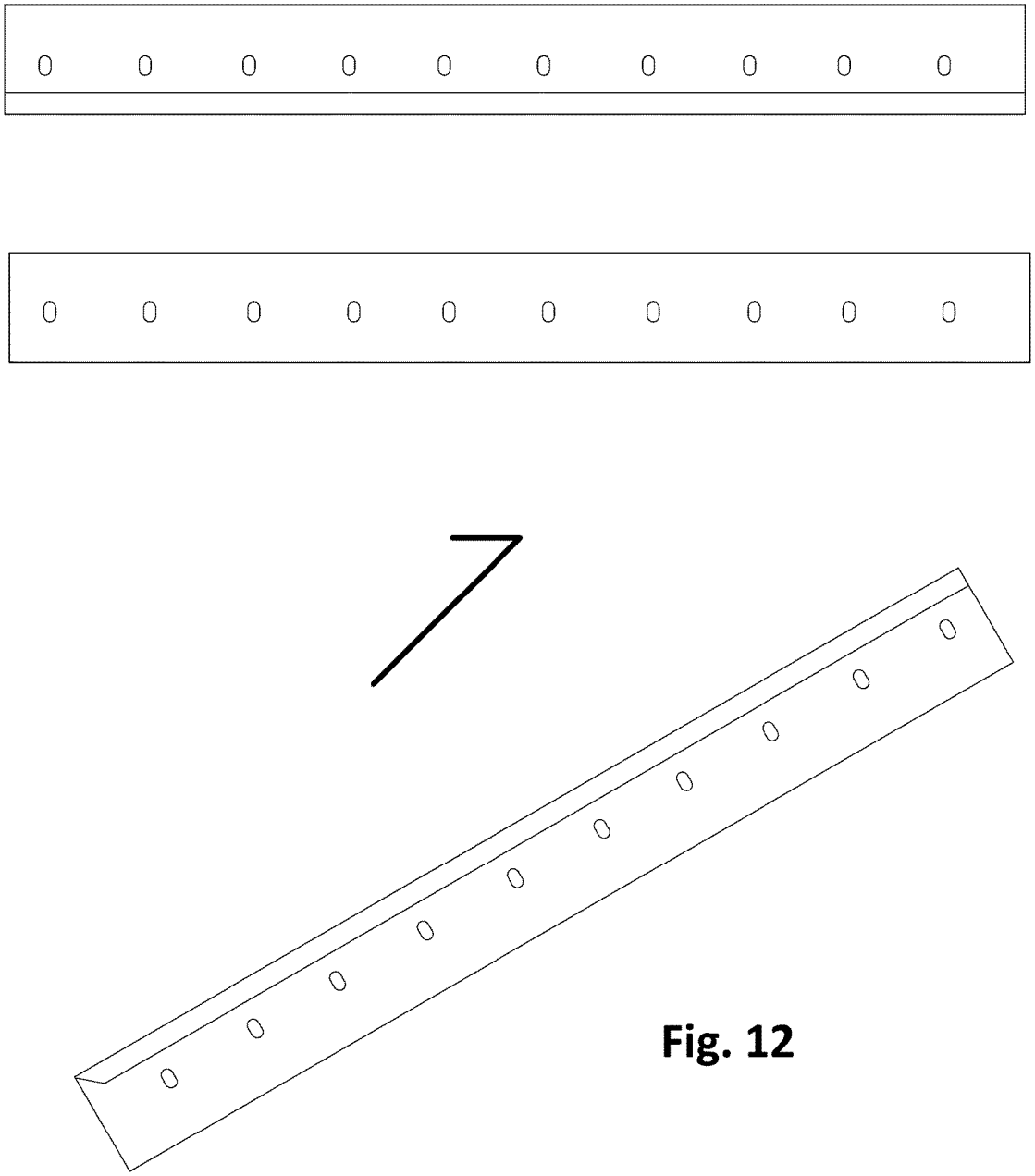
FIG. 12 is a number of views of an end cap.

As shown in FIG. 4, to cover the top 26 of the insulating panel 20 over the slope S, a segment of metal preferably aluminum known as the end cap E is fastened to the underside of the soffit 100 using fasteners (not shown), of suitable length to penetrate the existing wall sheathing 122 and covers the insulating panel 20 over the slope S. An end cap E is secured approximately 1 inch under the soffit 100 as in FIG. 8*b* (14) fastened through elongated holes H using suitable fasteners typically a wood screw type suitable length to penetrate the exterior wood sheathing 122.

Figure 14:
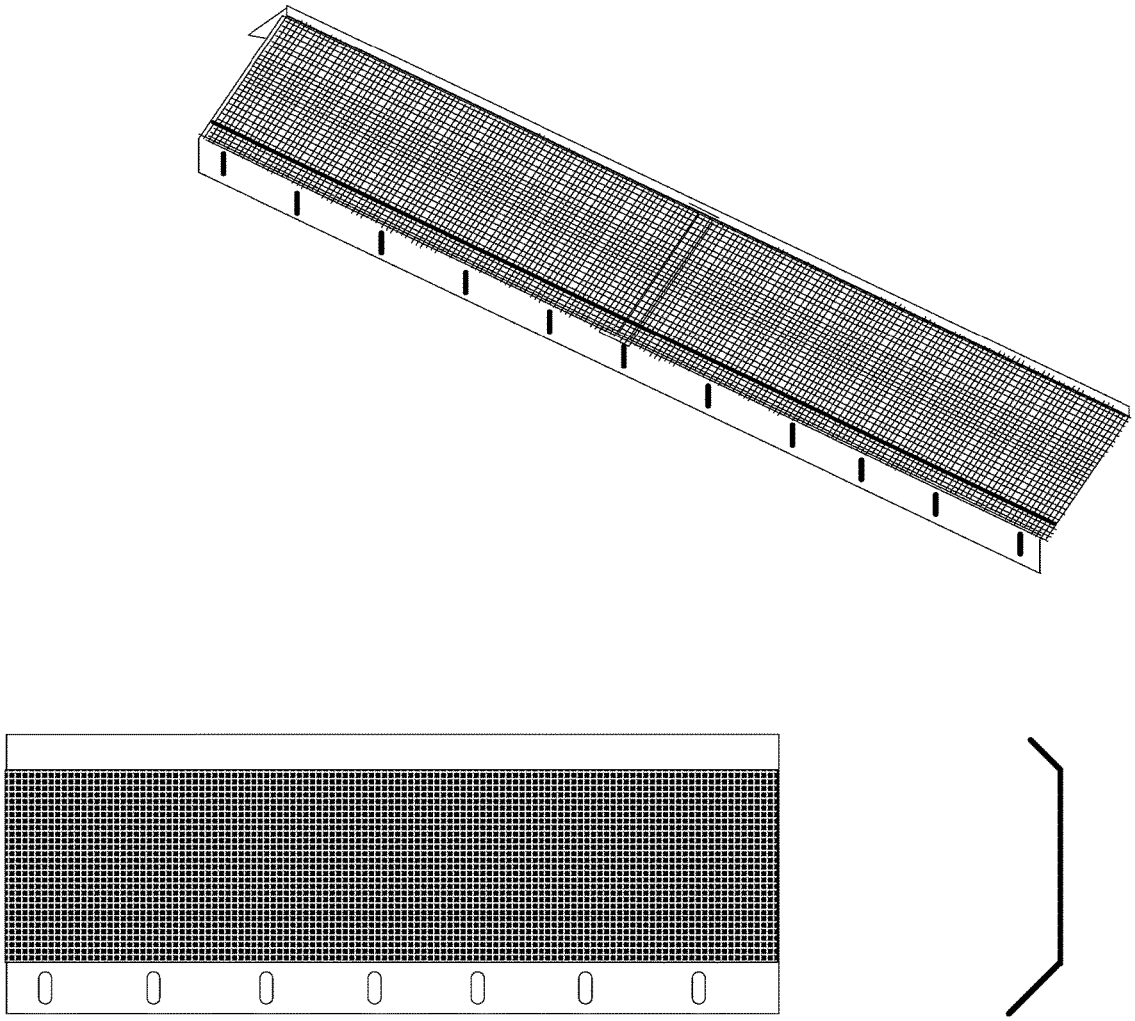
FIG. 14 is a number of views of an auxiliary panel having perforations in a main body portion thereof.

An auxiliary panel 40 is secured in the elongated clip member 30 and extends downwards and towards the insulated panel 20 at the outward-facing wall 26 near to the end of the slope S. As can best seen in FIGS. 4 and 14, the main body 44 of the auxiliary panel 40 is perforated (as is typical of a soffit 100).

The upper edge 42 of the auxiliary panel 40 is bent to form a 45-degree angle which is then folded back on itself to enable a hooked connection with the elongated clop member 30 and the lower edge 46 of the auxiliary panel 40 is also disposed at 45-degree so as to overlie the upper edge of the insulating panel 20 just below the termination of the slope S. The lower edge, having holes H therethrough, is then fastened through the insulating panel 20 and into the substrate (such as sheathing 122) by a fastener of the sort typically used in the EIFS industry.

After installation of the exterior insulating system 10, the exterior can be finished using a number of different products, not excluding EIFS which is a mesh and exterior coatings, which are then applied over the insulating panel 20 and the lower edge 46 of the auxiliary panel 30 to provide a stable, water-shedding finish.

The auxiliary panels 40 are joined end to end with an end clip 50 shown in the figures. The end clip 50 bridges of a pair of auxiliary panels 50 and receives the auxiliary panels 50 in respective slots 53 extending along the end clip 50 to hold the ends of the auxiliary panels 50 in place with one another. This same end clip 50 may be bent on its longitudinal axis as shown in the figures to facilitate installation of the auxiliary panel 40 in corners.

Figure 7:
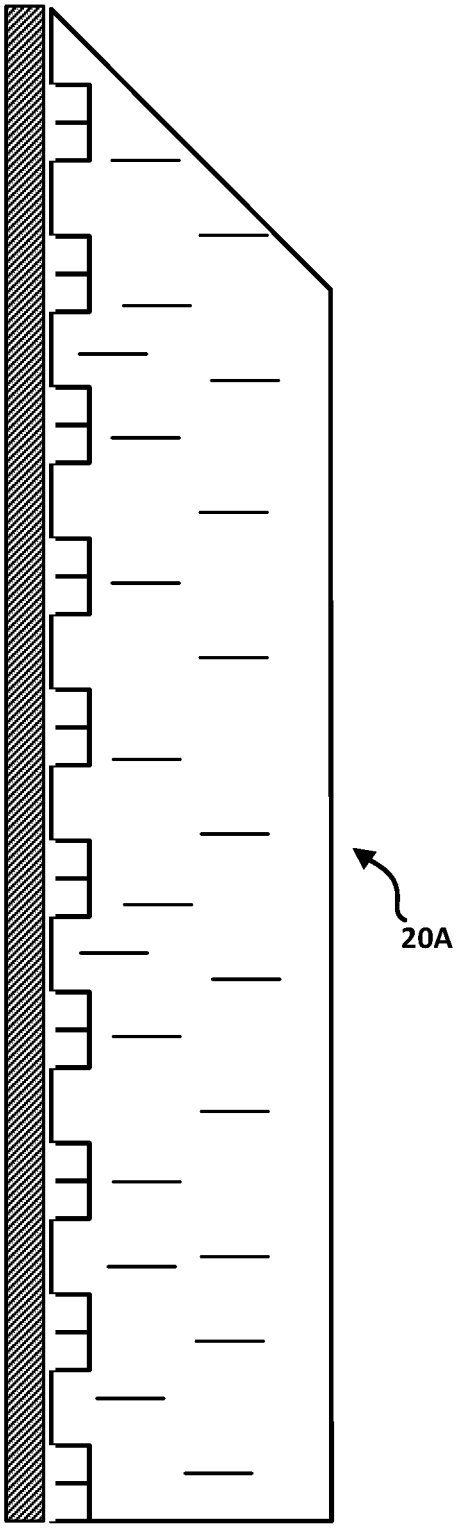
FIG. 7 is a side sectional view of portions of components of an alternative exterior insulating system 10 including an alternative insulation panel having pedestals for moisture management.
Figure 13:
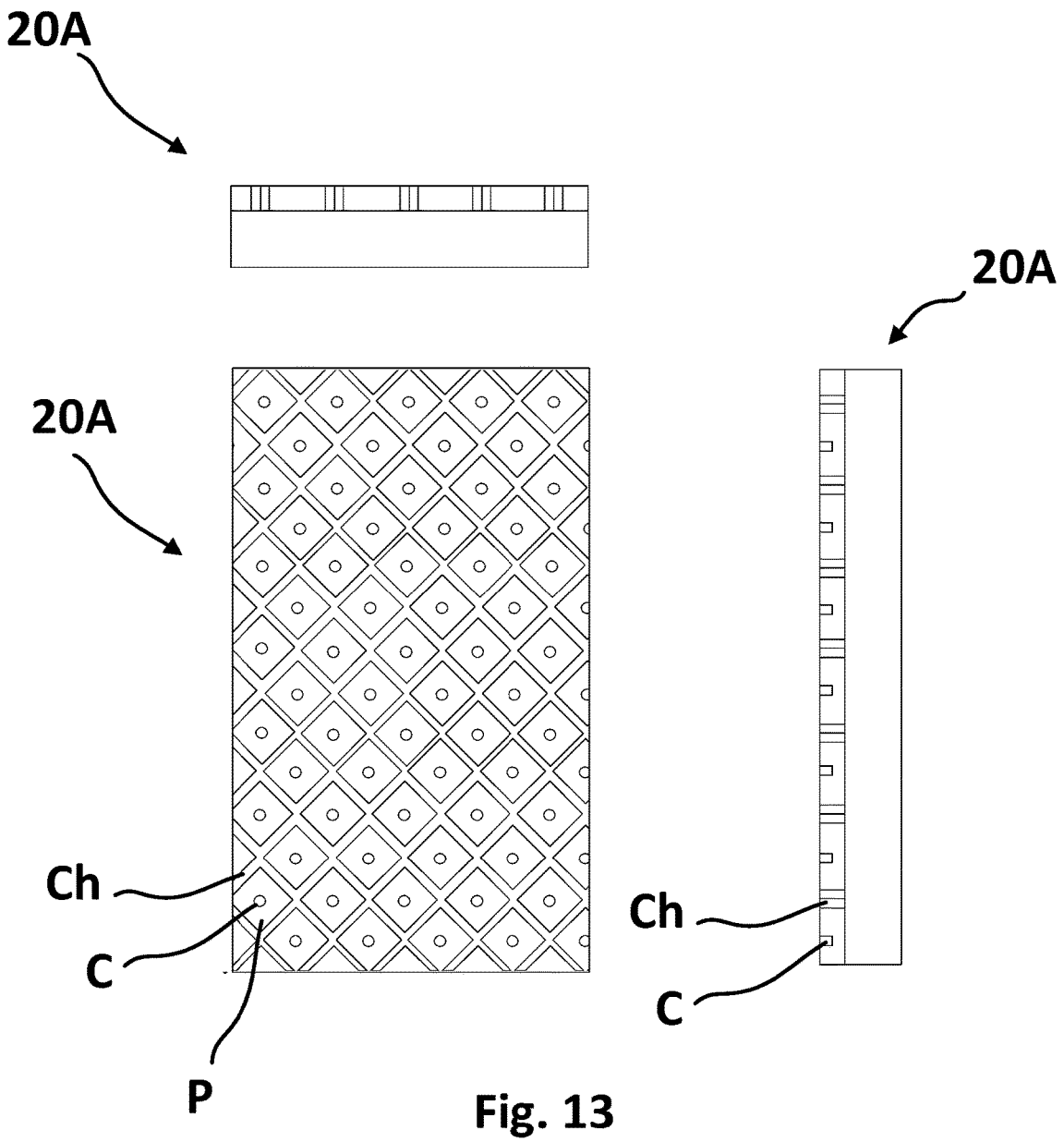
FIG. 13 is a number of views primarily of the wall-facing side of an alternative insulating panel having channels for water flow that are formed by the spacing of pedestals, and in which the pedestals have cavities therein.

In an embodiment, the wall-facing surface 22 of an alternative insulating panel 20A is configured to provide moisture management. FIG. 7 is a side sectional view of portions of components of an alternative exterior insulating system 10 including an alternative insulation panel 20A having pedestals for moisture management. FIG. 13 is a number of views primarily of the wall-facing side of an alternative insulating panel 20A having channels for water flow that are formed by the spacing of pedestals, and in which the pedestals have cavities therein;

Referring to the figures, in this alternative embodiment, the wall-facing surface 22 is formed with diamond-shaped pedestals P spaced from each other to create channels allowing air and liquid movement from the top 26 to the bottom 28 of the insulating panel 20A even while insulating panel 20A is against sheathing 122 of a wall W. At the bottom of the insulating panel 20A is a permeable "L"-shaped shelf or starter strip 23 made of perforated sheet metal or vinyl/plastic, as seen in FIG. 13.

The diamond pedestals P may be of any convenient size but it has been found that 6-inch sides with the apices of the diamonds spaced at 0.7 inches apart (FIG. 13) have proved satisfactory. The pedestals P are aligned on a rectilinear grid to provide angled flow channels at a width of 0.7 inches and a depth of 0.125 inches. The angled flow channels in particular have inclined edges that promote shedding of moisture rather than permitting a shelf or other horizontal surface on which moisture may rest and seep into sheathing 122.

In this embodiment, in the midsection of the pedestals P are respective 1-inch indentations or cavities "C" at approximately 0.125 inches. Such cavities C may perform like suction cups to enable improved adhesion to the wall W. It should be noted that the diamond shapes and dimensions of the pedestals P are made such that when insulating panel 20A is cut to any size during or in preparation for installation the pedestals P will serve as effective supports without undue shifting or "teeter-tottering" while thereby to maintain effective installation characteristics and drainage abilities.

The figures show alternatives in which the elongated clip member 30 in, for example, FIG. 1 is excluded and instead the upper edge 42 of the auxiliary panel 40 is pre-punched with holes through which appropriate fasteners may be passed for connection the alternative auxiliary panel 40 directly to a soffit 100 rather than through a clip member 30.

Although various embodiments have been described, alternatives are possible.

For example, the shape of the pedestals may be squares, rectangles, circles and ovals or other shapes.

Furthermore, the slope at the top of the insulating panel may not be a 45 degree bevel, but may be at some other angle of bevel. For example, in an alternative embodiment the slope is a bevel having an angle of from about 30 degrees to about 60 degrees with respect to the outward-facing side. In an embodiment, the slope is a bevel having an angle of from about 15 degrees to about 75 degrees with respect to the outward-facing side.

Figure 15:
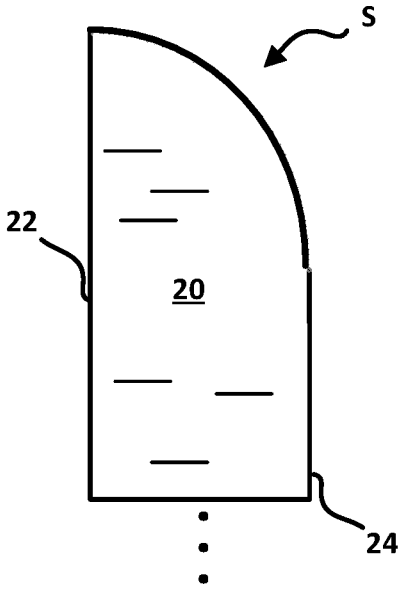
FIG. 15 is a side view of an alternative insulating panel having a curved slope rather than a beveled slope.

Still further, the slope may be a curve rather than a bevel. For example, FIG. 15 is a side view of an alternative insulating panel having a curved slope rather than a beveled slope.

What is claimed is:

1. An exterior insulating system for a building, the system comprising:

at least one insulating panel having a wall-facing side and an outward-facing side, a top and a bottom, the at least one insulating panel having a slope at the top that angles downwardly from the wall-facing side to the outward-facing side;

at least one elongated clip member fastenable along a soffit that is extending outwards from a wall of the building; and at least one auxiliary panel having a first edge that is dimensioned to be received by the at least one elongated clip member opposite a main body of the at least one auxiliary panel from a second edge of the at least one auxiliary panel that is connectable to the at least one insulating panel, the main body incorporating structure for permitting airflow through the main body.

2. The exterior insulating system of claim 1, wherein:

the wall-facing side of the at least one insulating panel comprises a plurality of channels arranged to convey liquid that is between the wall-facing side and a wall of the building downwardly towards the bottom.

3. The exterior insulating system of claim 2, wherein the wall-facing side comprises a plurality of pedestals spaced from one another thereby to form the plurality of channels.

4. The exterior insulating system of claim 3, wherein the plurality of pedestals have a square shape.

5. The exterior insulating system of claim 3, wherein each of the plurality of pedestals has a cavity in a midsection thereof that is open to the wall-facing side.

6. The exterior insulating system of claim 2, wherein the plurality of channels are open to the top and angle only downwardly thereby to permit liquid from towards the top of the at least one insulating panel to enter into the channels and to flow downwardly under gravity.

7. The exterior insulating system of claim 1, wherein the slope is a bevel having an angle of about 45 degrees with respect to the outward-facing side.

8. The exterior insulating system of claim 1, wherein the slope is a bevel having an angle of from about 30 degrees to about 60 degrees with respect to the outward-facing side.

9. The exterior insulating system of claim 1, wherein the slope is a bevel having an angle of from about 15 degrees to about 75 degrees with respect to the outward-facing side.

10. The exterior insulating system of claim 1, wherein the second edge of the at least one auxiliary panel comprises holes therethrough for receiving a fastener to fasten the second edge to the at least one insulating panel.

11. The exterior insulating system of claim 1, wherein the structure for permitting airflow through the main body comprises perforations.

* * * * *